United States Patent [19]

Edwards et al.

[11] 4,145,181

[45] Mar. 20, 1979

[54] APPARATUS TO FACILITATE JAM RECOVERY AND HOT ROLL REVERSAL IN A FUSING ASSEMBLY

[75] Inventors: Earl G. Edwards; Charles E. Peterson, both of Boulder, Colo.

[73] Assignee: International Business Machines Corporation, Armonk, N.Y.

[21] Appl. No.: 829,762

[22] Filed: Sep. 1, 1977

[51] Int. Cl.[2] ..... F27B 9/28; B65H 5/02

[52] U.S. Cl. ..... 432/60; 219/469; 355/3 FU; 100/93 RP; 271/273; 271/274

[58] Field of Search ..... 432/8, 59, 60, 75, 228; 219/216, 469; 355/3 FU; 100/93 RP, 176, 155 R; 271/273, 274, 195, DIG. 2; 118/60

[56] References Cited

U.S. PATENT DOCUMENTS

| | | | |
|---|---|---|---|
| 3,452,181 | 6/1969 | Stryjewski | 355/3 FU |
| 3,856,461 | 12/1974 | Jordan | 432/60 |
| 3,856,462 | 12/1974 | Mueller | 432/60 |
| 3,907,492 | 9/1975 | Draugelis et al. | 432/59 |
| 3,973,844 | 8/1976 | McCarroll | 432/228 |
| 4,050,803 | 9/1977 | McCarroll | 432/60 |

*Primary Examiner*—Henry C. Yuen
*Attorney, Agent, or Firm*—Francis A. Sirr

[57] ABSTRACT

Apparatus in a copier fusing assembly for distributing the wear on a hot roll occasioned by the use of variable length copy sheets. This wear is distributed over the horizontal length of the hot roll by reversing the hot roll, end-for-end. Easy reversal of the hot roll is made possible by utilization of a hot roll subframe which is removably mounted in the copier fuser mainframe. A hot roll handle on the subframe allows for manual removal of the subframe and hot roll from the mainframe and out of the copier where they are reversed and inserted back into the mainframe. Operation of a latch handle moves a sheet detach bar and sheet transport exit-ways away from the downstream side of the fusing nip to facilitate jam clearance.

5 Claims, 14 Drawing Figures

APPARATUS TO FACILITATE JAM RECOVERY AND HOT ROLL REVERSAL IN A FUSING ASSEMBLY

CROSS REFERENCE TO RELATED APPLICATIONS

Copending application Ser. No. 826,619, filed Aug. 22, 1977, and commonly assigned.

Copending application Ser. No. 771,126, filed Feb. 22, 1977, and commonly assigned, now U.S. Pat. No. 4,110,068.

Copending application Ser. No. 820,272, filed July 29, 1977, and commonly assigned.

BACKGROUND OF THE INVENTION

1. Field of the Invention

This invention relates generally to copier apparatus and more particularly to an improved fusing apparatus incorporating means to effect end-for-end reversal of the hot roll, and to effect jam clearance.

2. Prior Art

In a dry release hot roll fuser having paper fed with the long dimension parallel to the fuser rolls and referenced to one end of the fuser, the fusing of a large number of smaller sized copies, e.g., 11 inch copies, over an extended period of time, results in uneven wear of the coating on the hot roll surface. This wear produced by the 11 inch copy paper would not present a problem if this were the only paper size used, but as is well known in the art most copiers use variable lengths of paper. This wear can then have a deleterious effect when fusing larger copy paper, e.g., 14 inch copy. This wear condition can be relieved by reversing the hot roll, end-for-end, at regular intervals to distribute the wear over the surface of the hot roll. Currently, this requires removing several screws, other components, including the fuser heating lamp, and handling the hot roll cylinder itself. This operation must be done by a skilled technician at regular maintenance intervals and requires several minutes to complete.

OBJECTS OF THE INVENTION

It is an object of this invention to permit reversal of the fuser roll without the problem of disassembling and reassembling the fuser.

It is another object of this invention to permit the reversal of the hot roll with maximum simplicity and safety.

It is still another object of this invention to reduce the risk of component damage due to handling the hot roll.

It is yet another object of this invention to reduce the time expended in reversing the hot roll.

Another object of this invention is to improve the ease of both hot roll reversal and jam clearance.

SUMMARY OF THE INVENTION

The above objects are accomplished through the use of a hot roll subframe removably mounted to the fuser main frame without fasteners. The hot roll subframe carries the hot roll assembly, including the fuser heating lamp, and is structurally designed to resist all loads placed thereon when the two rolls come together to form a nip. The hot roll subframe further includes a handle mounted for manually lifting the hot roll from the main frame.

The hot roll subframe is indexed to the fuser main frame by positioning channels in the main frame into which end blocks on the subframe slide. Axial position of the subframe is secured by a positioning pin in the main frame which fits into a groove in one of the end blocks. Power is supplied to the fuser heating lamp through knifelike power connectors. The subframe is locked to the main frame and requires only rotation of a handle to unlock it.

Hot roll reversal is accomplished by actuating the latch handle to unlock the subframe from the main frame, rotating a shroud back from the copier fuser and lifting out the hot roll assembly by using the handle attached to the subframe. This approach allows hot roll reversal to be accomplished within a matter of a few seconds and reduces the risk of component damage due to handling. This latch handle also operates to move sheet handling devices away from the fusing nip, to facilitate manual sheet jam clearance.

The foregoing and other objects, features and advantages of the invention will be apparent from the following more particular description of the preferred embodiment of the invention, as illustrated in the accompanying drawing.

DESCRIPTION OF THE PREFERRED EMBODIMENT

Figure 1:
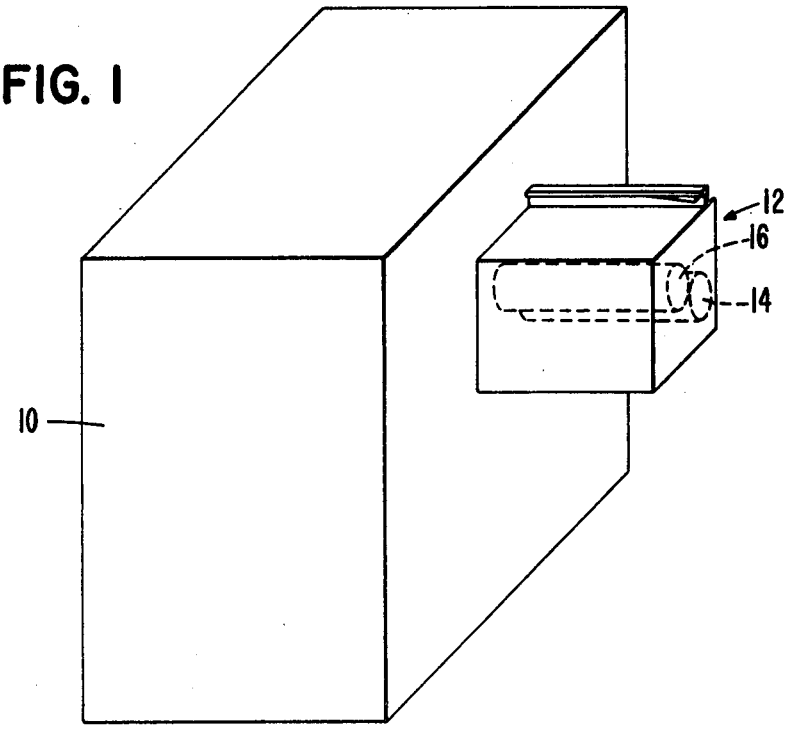
FIG. 1 is a general view of a copier incorporating the novel apparatus of the present invention.

FIG. 1 is a general view of xerographic copier 10 incorporating the present invention; for example, a copier of the type which is designated as the IBM Series III Copier/Duplicator. In FIG. 1, fuser assembly 12 is shown in its extended or pulled-out position in front of the copier, and is slidably supported within copier 10 by apparatus shown for purposes of simplicity. This is a nonoperating position adapted to facilitate inspection, cleaning, repair and/or sheet jam clearance.

Figure 2:
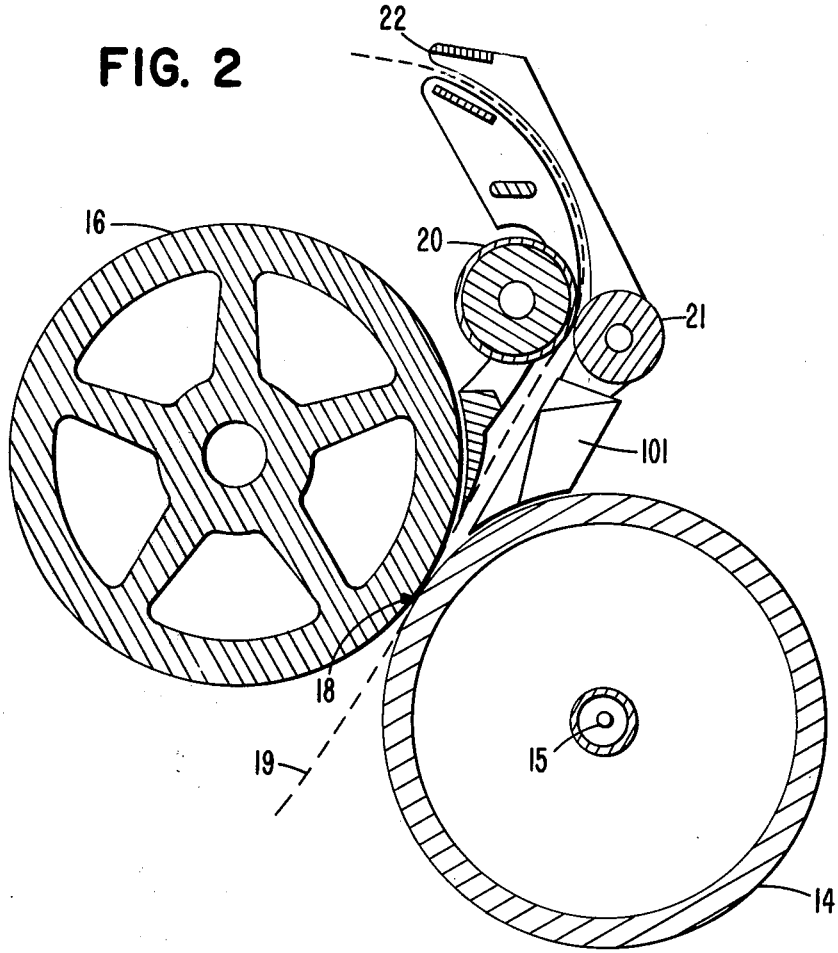
FIG. 2 is a simplified cross-sectional view, as seen from the front of the copier, showing the fusing nip, sheet detach bar and sheet transport exit-way.

The slidably supported fusing assembly 12 includes a hot roll 14 and a backup roll 16. Generally, hot roll 14 is heated to an accurately controlled temperature by an internal heater 15, as seen in FIG. 2, and an associated temperature control system which is not shown. Hot roll 14 preferably includes a deformable external surface formed as a thin elastomeric surface. This surface is designed to engage the toned side of a copy sheet which has a latent image formed thereon which was first located on a photoconductor surface (not shown). This image is transferred from the photoconductor to the copy sheet by first placing toner on the imaged surface of the photoconductor, with the toner adhering to the image formed thereon. Next, a suitable transfer means is used to transfer this toned image to the copy sheet. Hot roll 14, acting in concert with backup roll 16, fuses the image onto the copy sheet and readily releases the sheet with minimum adherance of residual toner to the hot roll. As is conventional in hot roll fusers, the sheet's toned side faces the hot roll.

Backup roll 16 is preferably a relatively cool and rigid roll. Both rolls 14 and 16 are circular cylinders and the fusing nip formed thereby defines a line (of some width due to deformation of hot roll 14) parallel to the axis of rolls 14 and 16.

The fusing nip formed by rolls 14 and 16 may be opened and closed in synchronism with the arrival and departure of copy sheet leading and trailing edges, respectively. This synchronism is achieved by a drum position sensing means which responds to the position of the photoconductor drum and effects opening and closing of the nip by means of a copier control system (not shown). In the alternative, for a multi-copy run, the fusing nip may continuously remain closed until the trailing end of the last sheet has passed therethrough.

FIG. 2 shows the fusing nip closed. Rigid backup roll 16 is shown to be in contact with resilient hot roll 14, thereby deforming the surface of hot roll 14 so as to form a fusing nip 18 of a certain width, measured in the direction of sheet movement 19. Feed roller 20 cooperating with idler roller 21 continues sheet movement 19 until a copy passing therethrough is free of fusing nip 18 and has passed through fuser exit-way 22.

Figure 3:
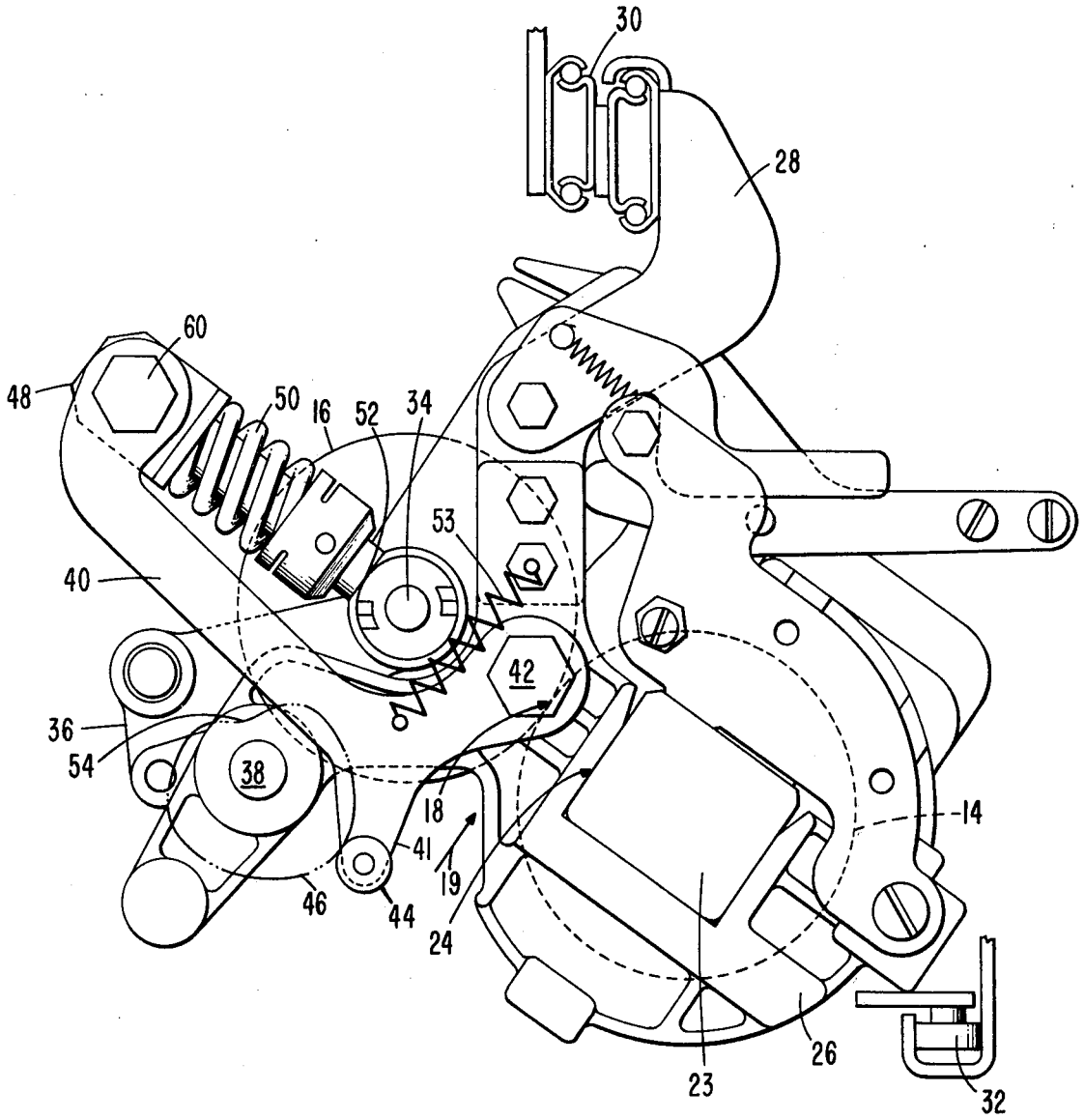
FIG. 3 is a diagrammatic view of a fusing assembly incorporating this invention.

In FIG. 3, hot roll 14 is removably, rotationally mounted on a fixed position axis in mounting blocks 23 which are supported by way of positioning surfaces 24 formed in the ends of a single piece mounting main frame member 26. This main frame member 26 includes a hanger which supports the fuser assembly by way of telescoping rails 30. Frame member 26 also includes rollers 32, or equivalent sliding bearings, which cooperate with a copier frame member to stabilize the fuser assembly position within the copier.

Figure 13:
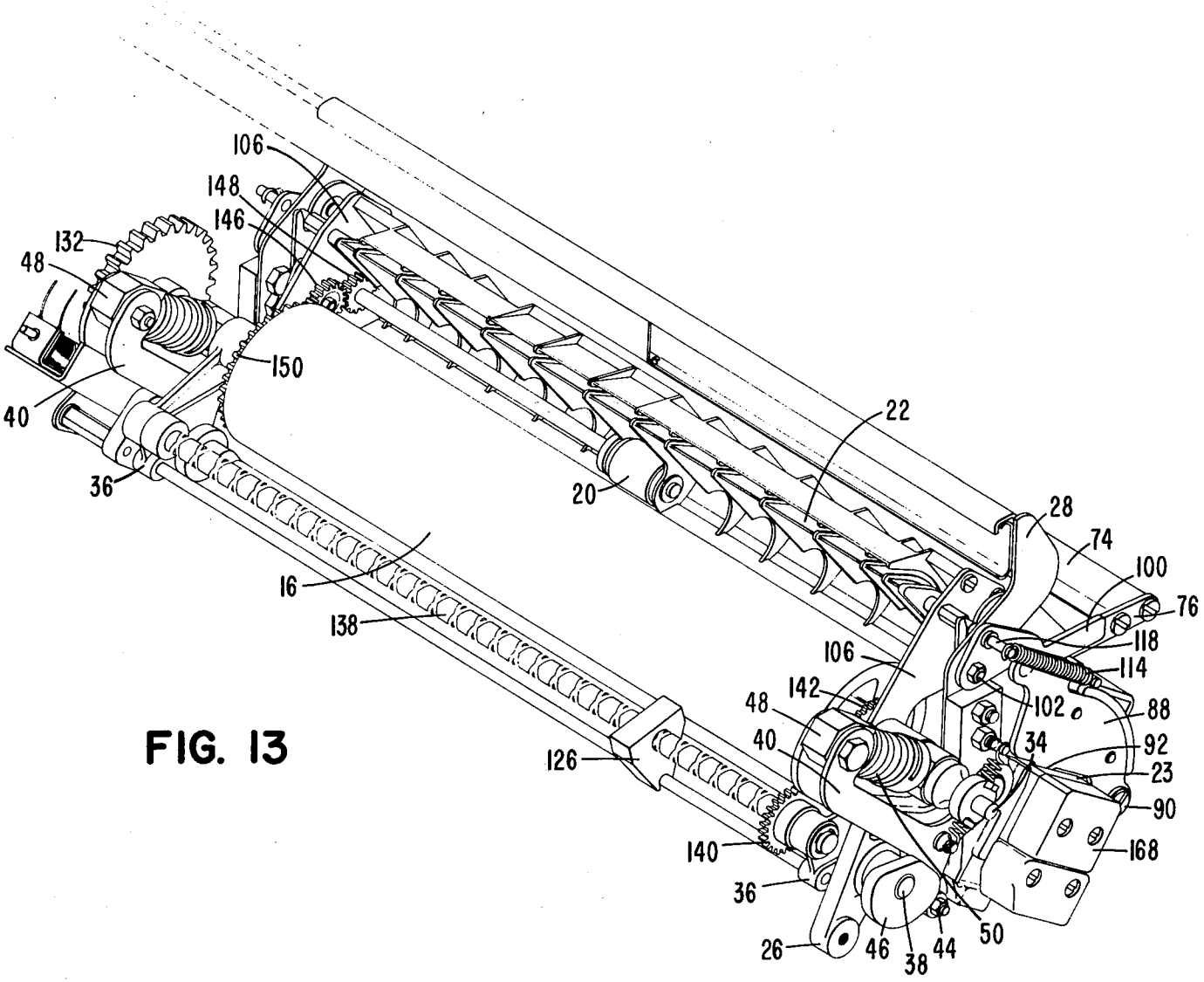
FIG. 13 is an overall perspective view of the fusing assembly.

As seen in FIGS. 3 and 13, roll 16 is rotationally supported, on axis 34, by way of pivoting cradle arms 36 at each end of frame member 26. These cradle arms are pivoted on the frame member at axis 38. Pivot arms 40, at each end of main frame member 26, are pivotably mounted to the frame member by way of pivot 42. Pivot arms 40 have downwardly extending projections 41 which support rollers 44 which cooperate with nip opening and closing cams 46. The other ends of pivot arms 40 have mounted thereon ends 48 of compressible force-cells 50. The other ends 52 of force-cells 50 operate on cradle arms 36 to cause arms 36 to rotate clockwise about axis 38, force cells 50 provide controlled pressure to backup roll 16 through axis 34, and consequently the pressure to fusing nip 18 is controlled. Springs 53, positioned between hanger 28 and pivot arms 40, provide an additional opening force to fuser nip 18.

Figure 5:
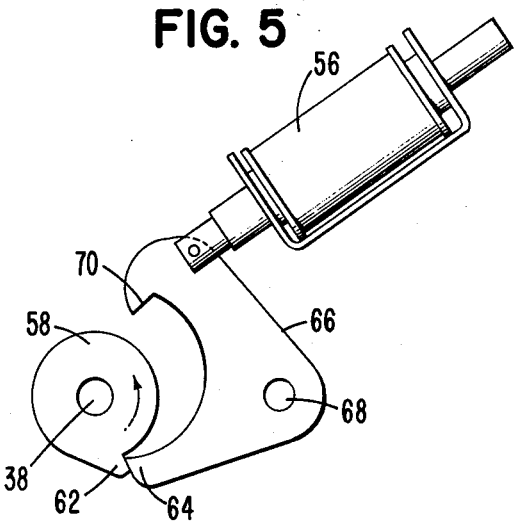
FIGS. 5 and 6 are exploded diagrammatic views of the solenoid, pivoting link and clutch as seen in FIG. 4.
Figure 6:
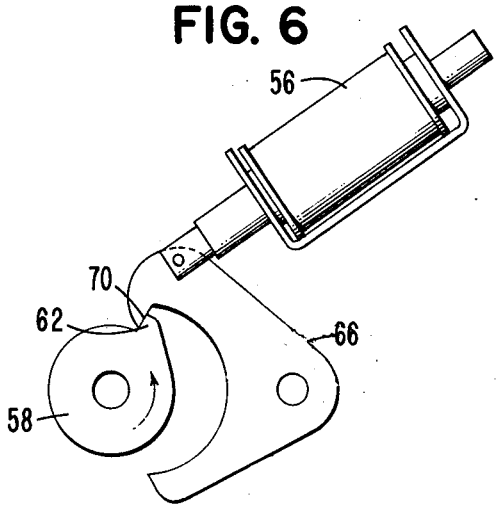

The closing of fusing nip 18 is achieved by cams 46 which are rotationally mounted on axis 38. These cams include a low point 54 which, when positioned to cooperate with roller 44, establish a nip-open condition. To close the nip, solenoid 56 is energized and clutch 58, shown in FIGS. 4–6, operates to rotate cams 46, in FIG. 3, clockwise 235° (counterclockwise if observing FIG. 4) to the position shown, causing nip 18 to close.

During nip closure, pivot arms 40 (see FIG. 3) rotate counterclockwise causing fixed-position pivot 42, force-cell pivot 60 and axis 34 to come into substantial alignment. However, pivot point 60 does not move overcenter. Thus, subsequent rotation of cams 46, back to the nip open cam position 54, as a result of the deenergization of solenoid 56, allows force-cell 50 to rotate pivot arms 40 clockwise (when observed on FIG. 3) about pivot 42, opening fusing nip 18.

Cams 46 are connected to rotate on axis 38 as long as clutch member 58 (FIGS. 5 and 6) is free to rotate. In the deenergized position of solenoid 56, dog 62 is held against rotation by tab 70 on pivoting link 66. Link 66 is pivoted at fixed position pivot 68. When solenoid 56 is energized, clutch member 58 and cam 46 are driven 235° until dog 62 engages tab 64. Fusing nip 18 is now closed. Subsequently, when it is desired to open the fusing nip, solenoid 56 is deenergized, link 66 returns to its deenergized position, and clutch member 58 rotates until it is stopped by tab 70. Fusing nip 18 is now opened.

The above-described means for opening and closing the fusing nip is more specifically described and claimed in a copending application, entitled "Hot Roll Fuser Roll Closure Apparatus", Ser. No. 826,619, filed Aug. 22, 1977, and assigned to the same assignee as the instant invention.

Figure 4:
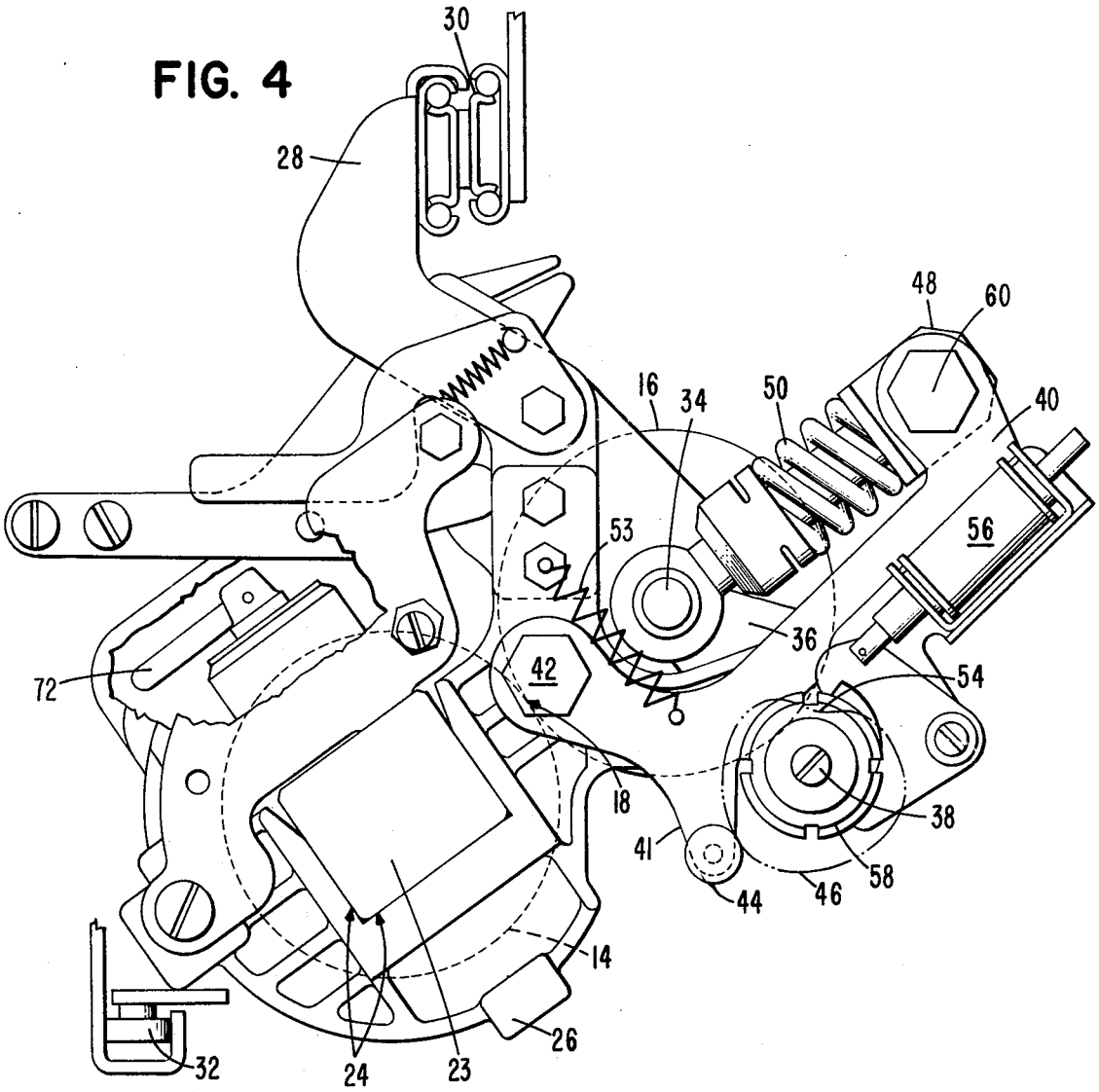
FIG. 4 is a diagrammatic view of a fusing assembly as in FIG. 3, but seen from the opposite side.

In the fragmented portion of FIG. 4, a folded hot roll handle 72, for manually removing hot roll 14, is shown. The use of this handle for removing hot roll 14 from the fusing assembly will be explained hereinafter.

Figure 7:
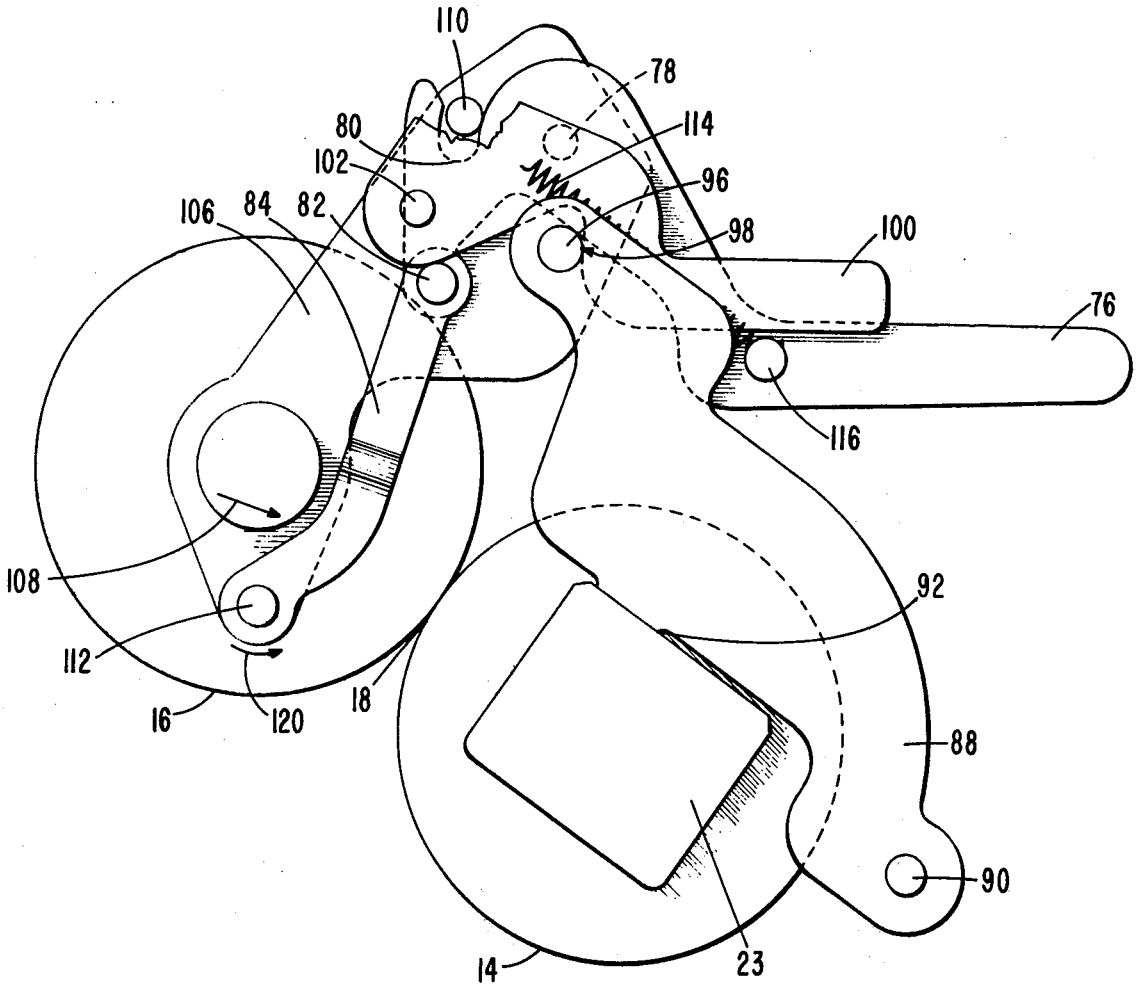
FIG. 7 is a diagrammatic view of a mechanism of this invention used to move associated hardware to facilitate access to the hot roll and backup roll area.
Figure 8:
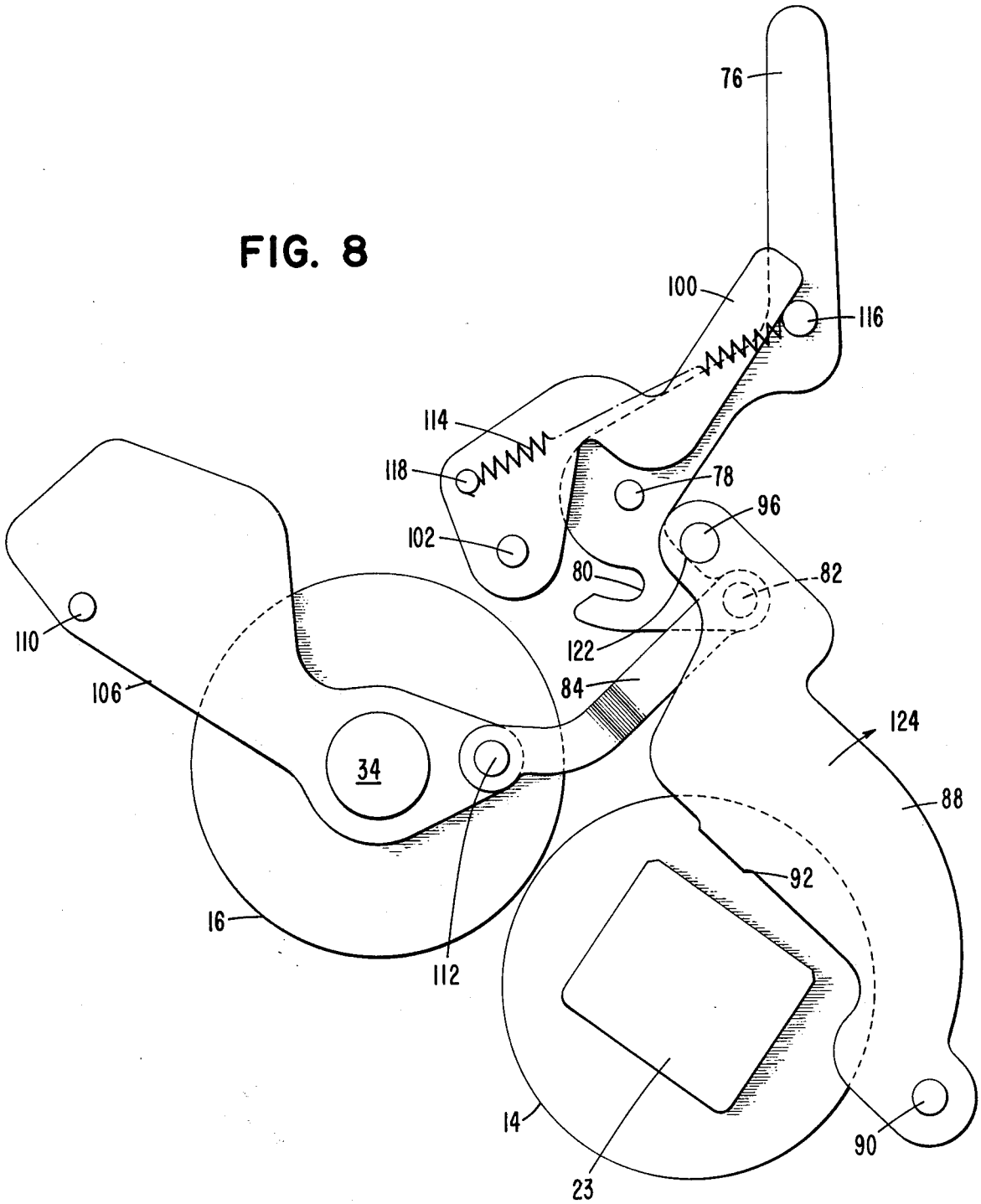
FIG. 8 is a diagrammatic view as in FIG. 7, with the associated hardware moved out of the way for access to the hot roll, cold roll and fusing nip.

In FIG. 13, a manually movable, rod-like handle 74 extends the length of the fuser assembly, parallel to axis 34. Opposite ends of this handle are attached to movable links 76, at each end of the fuser assembly. In FIGS. 7 and 8 it is seen that these links are pivoted on fixed-position axis 78. Both of the links have a notch 80, and a pivot point 82 for one end of a drive arm 84. In FIG. 7, links 76 are shown in their operative positions, wherein the hot roll detach bar, 101 of FIG. 2, and the fuser's output sheet transport channel or exit-way, 22 of FIG. 2, are located closely adjacent the downstream portion of fusing nip 18, shown closed in FIG. 2. U.S. Pat. No. 3,955,813, commonly assigned and incorporated herein by reference, describes this sheet output channel and describes and claims and detach bar.

Figure 14:
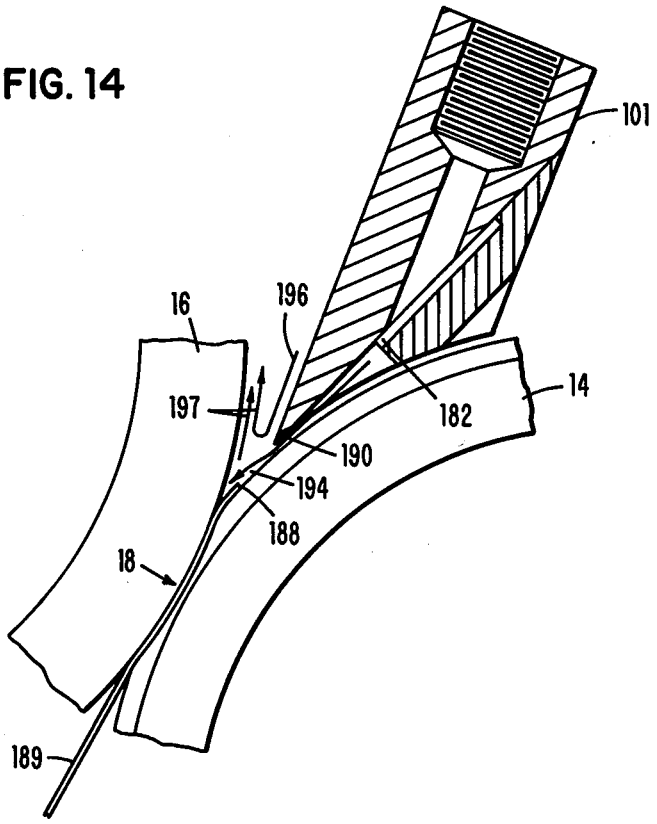
FIG. 14 is a view of FIG. 2's detach bar, showing the pneumatic detach means incorporated therein.

FIG. 14 is similar to FIG. 7 of U.S. Pat. No. 3,955,813, and shows the pneumatic detach means incorporated within detach bar 101.

FIG. 14 is a view of bar 101 with the leading edges 188 of a copy sheet 189 emerging from fusing nip 18. The flow of air from nozzle 182, into the gap formed by hot roll 14 and backup roll 16, is complex and not completely understood. However, it is believed that air begins to flow tangent to the hot roll, as shown at 190. It then follows the roll's contour, rather than flowing in a straight line, due to the well known Coanda flow effect. This flow pattern continues until the flow reaches the obstruction created by the fusing nip. This obstruction causes stagnation and lateral division of the airflow. In this stagnation process some of the jet's kinetic energy is converted to an increase in pressure which propogates upstream toward orifice 182 and causes the jet to separate as shown at 194. As a result, pressure differentials are created above the sheet. As the leading edge 188 of the copy sheet enters this flow, it is subjected to a force lifting it off roll 14. In addition, the forward facing step created by the sheet's leading edge, due to the paper's thickness, aids in separation of the leading edge by presenting another obstacle to jet flow.

In FIGS. 7, 8 and 13, links 88 are pivoted on fixed-position axis 90. Each of links 88 has a projection 92 thereon for holding mounting blocks 23 securely within main frame 26. Links 88 carry locking pins 96 which lock links 88, and the detach bar 101, in operative position by virtue of an interface at 98 between pin 96 and pivotable link 100. Links 100 are pivoted on fixed-position axis 102.

The ends of output sheet transport channel 22 are attached to links 106. These links are pivoted on backup roll axis 34. Axis 34 is not a fixed-positioned axis because during nip closure, axis 34 moves a slight distance downward, as represented by arrow 108 in FIG. 7.

The upper end of links 106 carry a locking pin 110, cooperating with notch 80 formed in links 76. The lower end of links 106 carry lower pivot axis 112 for the end of drive arm 84 that is opposite pivot point 82.

In FIG. 8, two tension springs 114 extend between pins 116 carried by links 76 and pins 118 carried by links 100. The springs provide a closing force between links 76 and links 100. In addition to providing a closing force between links 76 and links 100, springs 114 provide a contacting force between pins 96 and pivotable links 100. The above-mentioned interface 98 is created by these latter two sets of links.

In order to move the above-mentioned detach bar and output sheet transport channel out of the way for jam clearance and/or to remove hot roll 14, the above-mentioned rod-like handle 74 is lifted up and rotated counterclockwise about fixed-position axis 78, to the position shown in FIG. 8. This causes the detach bar to generally rotate clockwise about hot roll 14 away from fusing nip 18, and the output sheet transport channel to generally rotate counterclockwise about backup roll 16.

During such movement, pins 116 on links 76 engage links 100 and cause these links to pivot counterclockwise about their fixed-position axis 102. As a result, interface 98, as seen in FIG. 7, created by contact between pins 98 and pivoted links 100 is broken. In FIG. 8, as handle-actuated links 76 continue to rotate counterclockwise, notches 80 free pins 110. Counterclockwise rotation of links 76 transmits counterclockwise rotation to links 106 by virtue of drive arms 84. As pivot axis 112 moves counterclockwise as represented by arrow 120 in FIG. 7, to its position in FIG. 8, links 106 are pivoted clear of fusing nip 18. As counterclockwise rotation of links 76 continues, surfaces 122 formed thereon engage locking pin 96, causing links 88 to rotate clockwise about their fixed-position axis 90.

The detach bar and output sheet transport channel have now been moved out of the fusing nip for manual sheet jam clearance. In addition, link 88 has been pivoted clockwise, eliminating the interface between projection 92 on links 88 and mounting blocks 23. Links 88 can now be manually rotated clockwise, as represented by arrow 124 in FIG. 8, in order that hot roll 14 can be removed from main frame 26.

In summary, interface 98 locks the detach bar in operative position, notch 80 and pin 110 lock the output sheet transport channel in operative position, spring 114 maintains interface 98, pin 116 lifts link 100 to interrupt interface 98, counterclockwise rotation of link 76 frees pin 110 and rotates link 106 by virtue of drive arm 84, and counterclockwise rotation of link 76 rotates link 88 clockwise as a result of interference with locking pin 96.

A jam clearance means of the above-mentioned generic type is described and claimed in copending application Ser. No. 771,126, filed Feb. 22, 1977, now U.S. Pat. No. 4,110,068, and assigned to the assignee of the instant invention.

Figure 9:
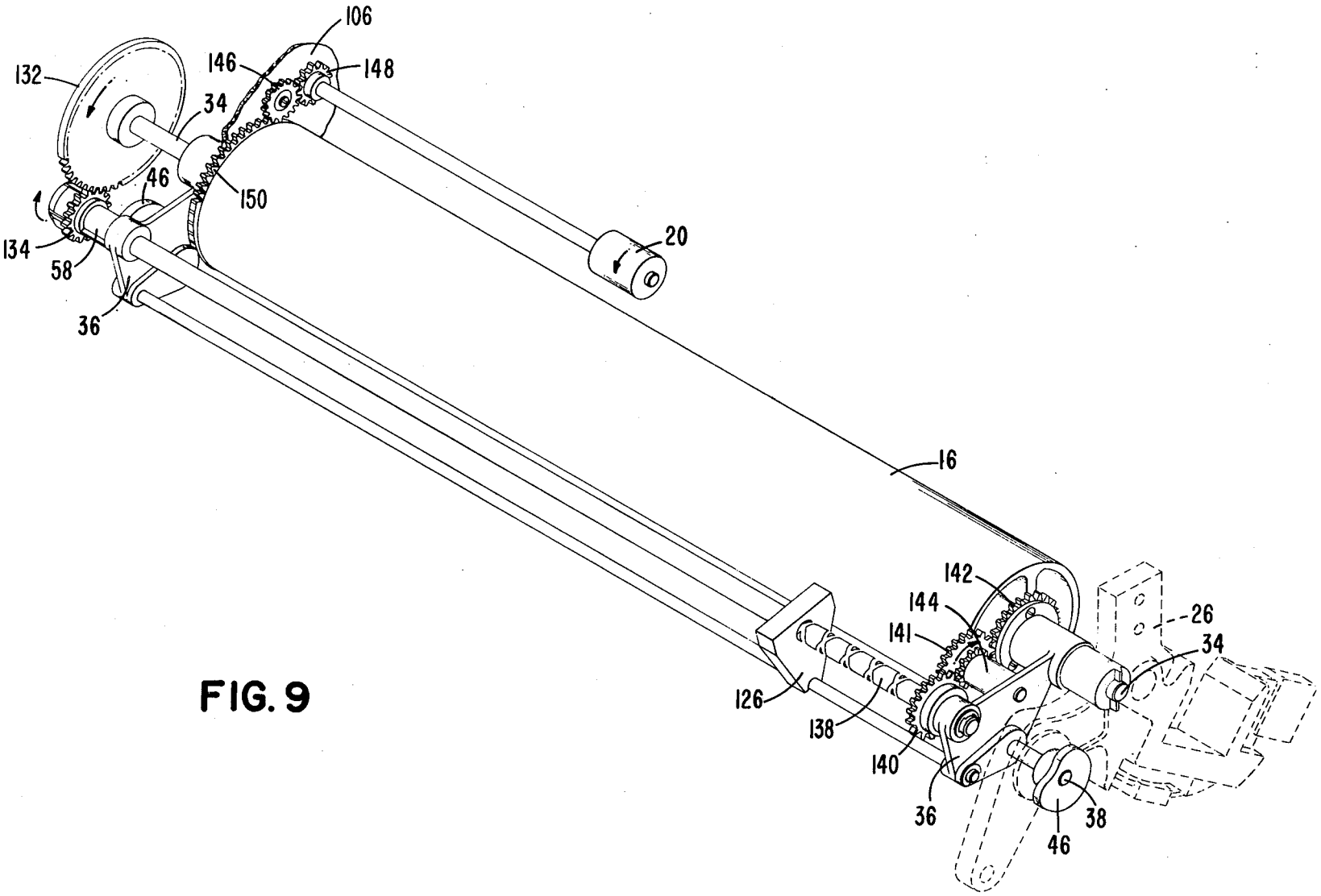
FIG. 9 is a perspective view of the fixed center drive for producing rotation of the backup roll, the backup roll's scraping blade cleaner and the fuser's paper exit guide transport roller.

FIG. 9 shows the fixed center drives for (1) producing rotation of the fuser's backup roll 16, (2) producing oscillatory movement of the backup roll's scraping blade cleaner 126, and (3) producing rotation fo the fuser's paper exit guide transport roller 20. Roller 20 is supported by the exit paper transport guides, and engages the non-toner side of a sheet, as the sheet emerges from fusing nip 18. Additional information pertaining to the blade cleaner 126 appears in IBM TECHNICAL DISCLOSURE BULLETIN, Volume 18, No. 2, July 1975, pages 326–327.

Counterclockwise rotation of backup roll 16 is produced by gear 132 which meshes with continuously driven gear 134. Gear 132 is connected to the backup roll's axis 34 and causes counterclockwise rotation of this roll. When the fusing nip is being closed or opened, the backup roll's rotational axis 34 moves in an arc about axis 38. Thus, gear 132 merely rolls about its meshing gear 134.

Cleaner 126 is supported by double helix lead screw 138. This lead screw is driven in a counterclockwise direction by virtue of gears 140–142 with gear 140 being fixedly mounted on an end of lead screw 138, gear 141 being rotatively mounted on fixed axis 144 and gear 142 being fixedly mounted on axis 34. Since all of these gears are carried by cradle arm 36, a fixed center relationship is maintained during nip opening and closing.

As a sheet of newly fused copy paper emerges from the fusing nip, and as it is driven by counterclockwise rotation of backup roll 16, its leading edge is guided into the output sheet transport channel (not shown in FIG. 9). This sheet channel is supported by pivoting links 106. Links 106 supported at the rear end of the fuser, and shown in FIGS. 9 and 13, carry a pair of gears 146, 148 which mesh with a gear 150 which is integral with backup roll 16. Counterclockwise rotation of sheet transport roller 20 by gears 146, 148 and 150 transports the copy paper out of the fusing nip. Roller 20 cooperates with idler roller 21, shown in FIG. 2, to trap the copy sheet therebetween. The idler roller engages the toned side of the copy sheet.

When the fuser's sheet detach bar and output sheet transport channel are manually moved out of the way, as for jam clearance, links 106 rotate in a counterclockwise direction as discussed above with reference to FIGS. 7 and 8. Since link 106 pivots about the backup roll's rotational axis 34, a fixed center is maintained for gears 146–150, and gears 146 and 148 merely rotate in a circle about gear 150. Consequently, a constant center distance between the gears is maintained and transport roller 20 is driven with minimum backlash by the gearing.

Figure 10:
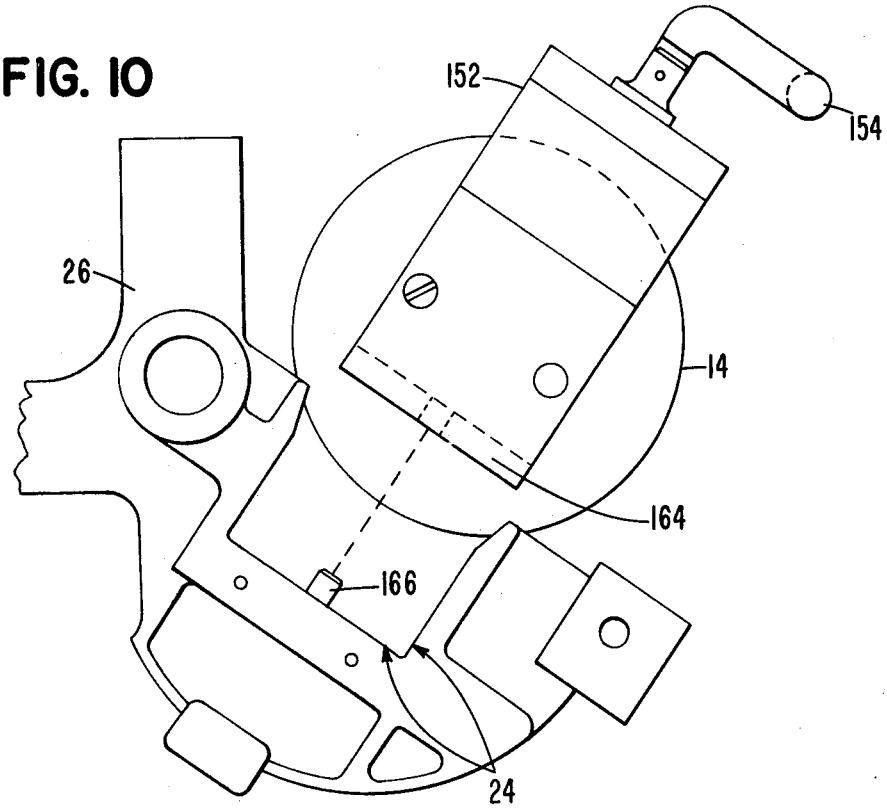
FIG. 10 is a partially fragmented diagrammatic view showing removal of the subframe from the main frame in the fusing assembly area.
Figure 11:
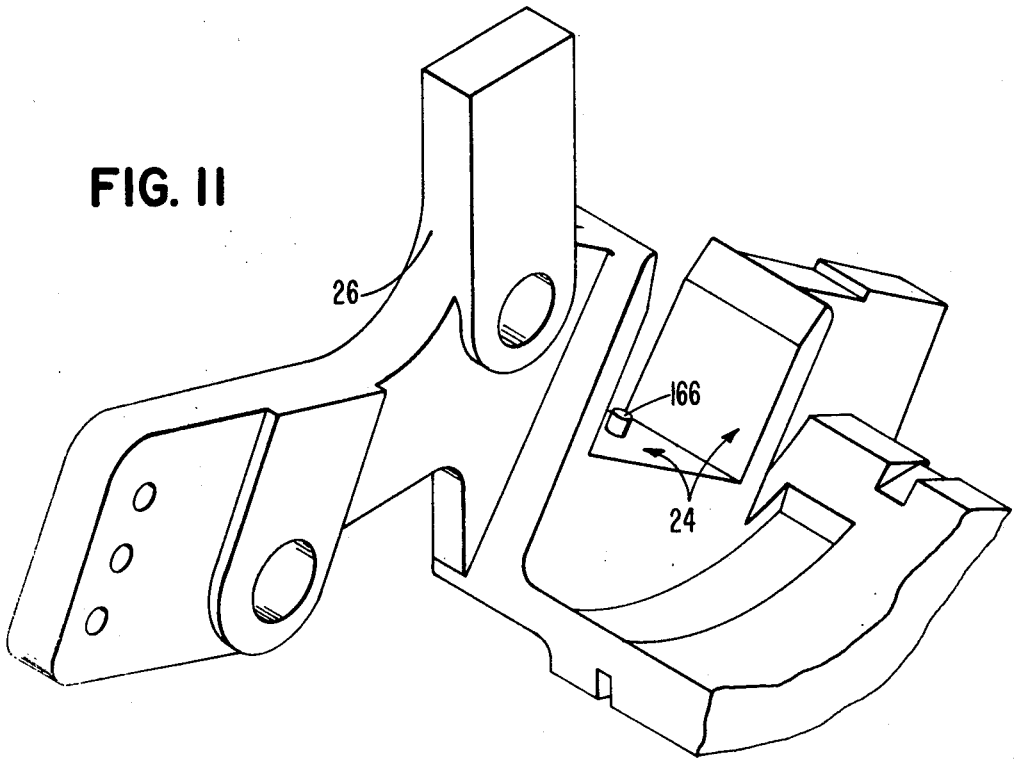
FIG. 11 is a partially fragmented, exploded perspective view of the positioning surfaces and pin in the main frame for supporting the subframe.

The fuser's main frame member 26, shown in FIGS. 10 and 11, comprises a central portion surrounding, but spaced from, the surface of hot roll 14 and having upstanding end flanges establishing the various rotational axes of the backup roll and its associated structure. These end flanges include U-shaped slots or positioning surfaces 24 adapted to receive the ends of the reversible hot roll.

Figure 12:
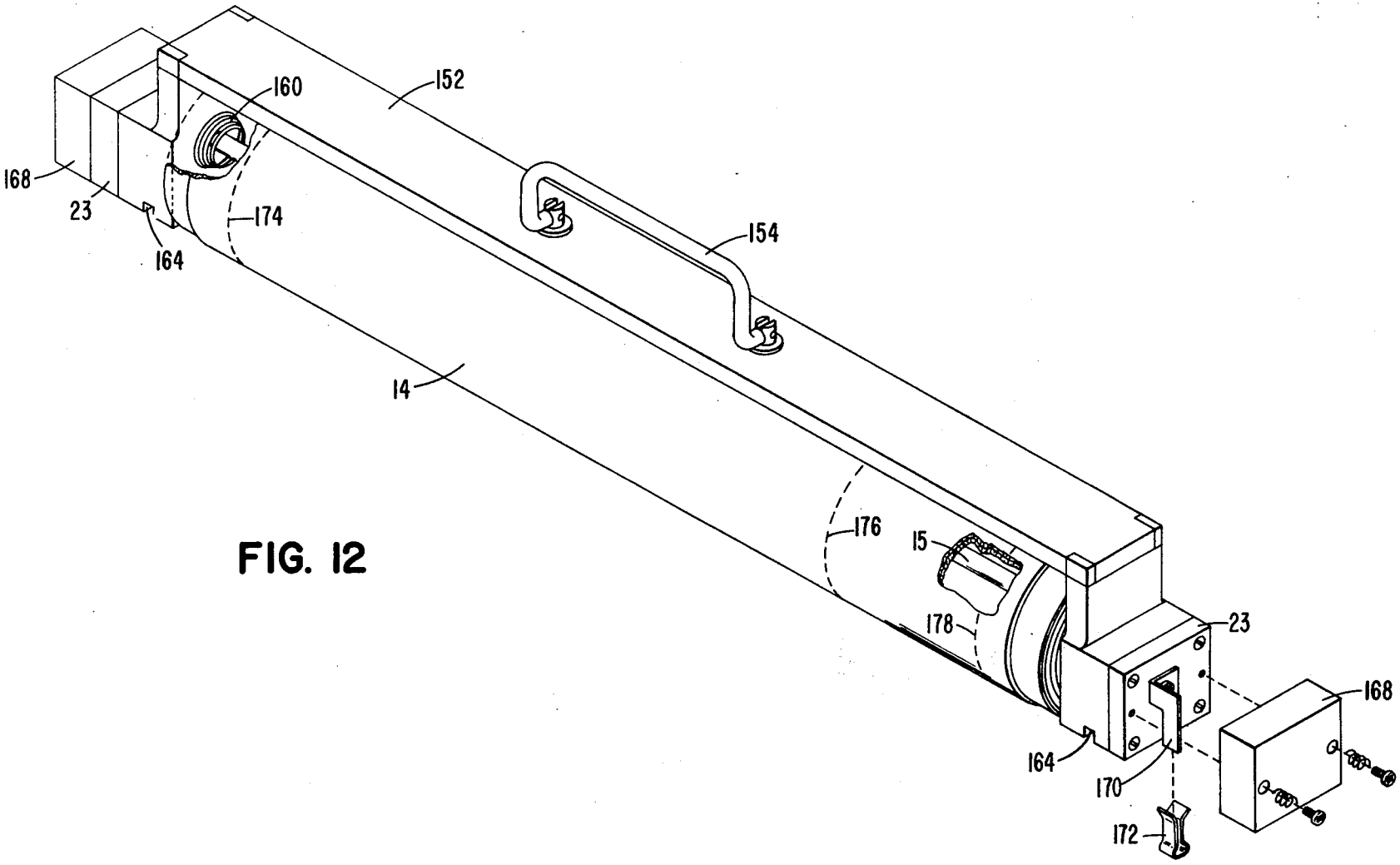
FIG. 12 is an exploded perspective view partially in section showing the U-shaped metal subframe member and the handle thereon for effecting removal of the subframe from the main frame of FIG. 10.

With reference to FIG. 12, hot roll 14 is rotationally mounted in rigid U-shaped subframe member 152 which is symmetrically located between positioning surfaces 24. Subframe 152 is locked to main frame 26 and is unlocked therefrom by rotation of rotatable handle 74. A handle 154 shown folded in FIG. 10 and shown extended in FIG. 12, is mounted on the central portion of subframe member 152.

Each end of the not roll is supported for substantially frictionless rotation in metal end blocks 23. End blocks 23 each have a stub shaft which fits into bearings at both ends of hot roll 14. Hot roll 14 is easily replaceable because metal end blocks 23 are removable from subframe 152. These end blocks are substantially identical, the only exception being that one end block cooperates with a helix compression spring 160 which axially biases hot roll 14 towards the other end block for retention purposes. End blocks 23 nonrotationally support heating element 15, as also seen in FIG. 2, on the hot roll's axis of rotation. A hot roll core temperature sensor (not shown) is mounted on main frame 26 under and in contact with hot roll 14. Hot roll 14 is driven in a clockwise (FIG. 2) direction by frictional engagement with counterclockwise rotating backup roll 16 when the fusing nip is closed.

As seen in FIG. 12, both end blocks 23 have a mounting channel 164. Channels 164 are of uniform cross-section and run perpendicular to the hot roll's axis of rotation. As shown in FIGS. 10 and 11, the back mounting channel only of main frame member 26 includes a positioning pin 166 adapted to mate with channel 164 in the end block adjacent helix compression spring 160. The front positioning channel of main frame member 26, however, does not include such a positioning pin.

Each end of the reversible subframe member 152, in FIG. 12, includes an electrical connector portion 168, one of which is exploded and separated from end block 23 to illustrate electrical connector 170. Connector 172 is insulatively mounted on the main frame member's forward end flange. The rear one of these connectors 168 is maintained in a fixed position by virtue of locking engagement between channel 164 and pin 166. Electrical connector 170 experiences movement along the axis of the hot roll as the temperature of the hot roll's U-shaped subframe member 152 changes. Metallic U-shaped subframe member 152 expands and contracts with temperature changes. However, since connector member 172 has a channel extending in a direction parallel to the axis of the hot roll, sliding movement of connector 170 within the channel of member 172 is accommodated.

STATEMENT OF THE OPERATION

Paper is fed through the copier with its long dimension parallel to the hot roll's rotational axis, and with sheets of various sizes referenced to a common rear side edge (corresponding to the common corner registration for all original documents to be copied on the master document support glass). This rear edge is indicated by broken line 174 in FIG. 12. The forward edge of an 8½ × 11 inch sheet of paper would reside at broken line 176, whereas the forward edge of and 8½ × 14 inch sheet of paper would reside at broken line 178. The hot roll's variable forward working area 176–178 makes it desirable to reverse hot roll 14, end-for-end, periodically to distribute wear on the hot roll.

Before removing subframe 152 and hot roll 14 out of the fuser assembly 12, subframe 152 is unlocked from main frame 26 by actuating rotatable handle 74 and movable links 76 which rotate links 88 clear of mounting blocks 23. A shroud (not shown) which overlies hot roll 14 is pivoted clear of the roll and foldable handle 154 is unfolded to allow for the lifting of hot roll 14, including subframe 152, out of main frame 26. With reference to FIG. 12, as subframe 152 is lifted, the connection between positioning pin 166 and channel 164 in end block 23 is broken. The electrical connection between the male and female connectors on the other end block 23 and main frame 26 respectively, is also broken. The upward motion of subframe 152 continues and end blocks 23 continue sliding until free of positioning surfaces 24. Once out of main frame 26 and the fusing area, subframe 152 is reversed, end for end. After reversal of subframe 152, the above steps are reversed until subframe 152 is again locked to main frame 26. Even though the handle for lifting subframe 152 out of the copier is shown and described as being permanently attached to subframe 152, it should be understood by those having skill in the art that modifications to the handle-subframe configuration can be made. For example, handle 154 could be detachable and stored until needed to remove subframe 152 from the copier. These simple manual steps allow hot roll reversal to be accomplished within a short period and also reduce the risk of component damage due to handling. Additionally, the hot roll core temperature sensor is not disturbed during reversal of the hot roll.

The use of handle 154 for removing hot roll 14 from the fusing assembly is more specifically described and claimed in a copending application, entitled "Apparatus for the Reversal of a Hot Roll in a Fusing Assembly", Ser. No. 820,272, filed July 29, 1977, now U.S. Pat. No. 4,121,089, and assigned to the same assignee as the instant invention.

While the invention has been shown and described with reference to a preferred embodiment thereof, it will be appreciated by those of skill in the art that variations in form may be made therein without departing from the spirit and scope of the invention.

What is claimed is:

1. In a hot roll fuser having a hot roll and a backup roll operable to form a fusing nip, the combination comprising:

main frame means having slidable coupling means to receive and releasably hold said hot roll;

sheet path control means cooperating with a sheet as it emerges from said fusing nip, and operable to guide the sheet away from the nip; and first link means pivotally mounted on said main frame and mounting said sheet path control means;

said first link means being movable from a first position whereat it locks said hot roll in said main frame member, and supports said sheet path control means at said nip, to a second position whereat said hot roll is unlocked for manual removal, and said sheet path control means is moved away from said fusing nip to facilitate manual jam clearance.

2. The hot roll fuser defined in claim 1 wherein said hot roll and said backup roll are arranged to be relatively movable between nip open and closed positions, so that in the closed position the rolls pressure engage to form said fusing nip, wherein said main frame means supports said hot roll on a fixed-position rotation axis, second link means pivotably mounted on said main frame member and movably supporting said backup roll on a movable-position axis parallel to the rotation axis of said hot roll, and nip closing means cooperating with said second link means and operable to selectively move said backup roll into and out of engagement with said hot roll.

3. The hot roll fuser defined in claim 2 including:

sheet transport means;

third link means pivotally mounted on the axis of rotation of said backup roll and mounting said transport means;

said third link means being movable from a first locked position whereat it supports said sheet transport means to receive a sheet from said sheet path control means, to a second unlocked position whereat said sheet transport means is moved away from said fusing nip to facilitate manual jam clearance; and manual handle means operable to produce simultaneous operation of said first and third link means between said first and second positions.

4. The hot roll fuser defined in claim 3 wherein said sheet path control means includes pneumatic detach means to lift the leading edge of a sheet from said hot roll as the leading edge emerges from said fusing nip.

5. The hot roll fuser defined in claim 4 wherein said sheet transport means includes a driven sheet transport conveyor, drive means operable to drive said backup roll, and gear means mounted on said third link means and coupling said backup roll to said driven sheet transport conveyor, said gear means having a constant distance between meshing teeth of said gear means for all positions of said third link means.

* * * * *